United States Patent [19]

Rosenberg

[11] 4,027,882

[45] June 7, 1977

[54] FRANCHISE BOARD GAME

[76] Inventor: John D. Rosenberg, 200 Highland Ave., State College, Pa. 16801

[22] Filed: June 23, 1976

[21] Appl. No.: 699,170

[52] U.S. Cl. ..... 273/134 AT; 273/134 AG; 273/134 GM; 273/134 DB; 273/134 CB; 273/136 C

[51] Int. Cl.[2] ..... A63F 3/00

[58] Field of Search ..... 273/134

[56] References Cited

UNITED STATES PATENTS

| | | | |
|---|---|---|---|
| 3,817,531 | 6/1974 | King et al. | 273/134 AT UX |

FOREIGN PATENTS OR APPLICATIONS

| | | | |
|---|---|---|---|
| 627,951 | 8/1949 | United Kingdom | 273/134 AT |
| 687,840 | 2/1953 | United Kingdom | 273/134 AT |
| 1,432,761 | 4/1976 | United Kingdom | 273/134 AT |

*Primary Examiner*—Delbert B. Lowe
*Attorney, Agent, or Firm*—Cushman, Darby & Cushman

[57] ABSTRACT

A parlor game primarily for the simulation of the building-up and maintenance of an athletic team, and competition with other teams in games during a season. A game board has indicia associated with each of the consecutive playing sections thereof, and a plurality of movable game pieces are provided for movement around the game board, one piece for each participant. A player board is provided for each participant, as well as a plurality of player pieces utilized to build up a sports team on a player board, at least two different indicia being provided for distinguishing two different types of player pieces. Dice are employed to advance the game pieces around the game board, and player piece selection cards (having indicia thereon corresponding to the indicia distinguishing between the different types of player pieces and indicia corresponding to player piece placement on the player board) are provided for facilitating the build up and maintenance of a sports team. Selected playing sections on the game board have indicia indicating that the chance player piece selection cards may be employed.

10 Claims, 6 Drawing Figures

FRANCHISE BOARD GAME

BACKGROUND AND SUMMARY OF THE INVENTION

The present invention relates to parlor games in general and in particular to the building up of a sports team or the like and the playing of a season with the sports team acquired, while continuously changing the composition of the team depending upon existing circumstances. The game may be played by any number of participants, although normally play is best when there is an even number of participants.

There is a wide variety of prior art board games in which participants utilize a combination of luck and skill to amass capital, complete pictures, acquire the most points, etc., such as shown in U.S. Pat. Nos. 2,026,082 and 3,817,531, and British Pat. No. 687,840. Such games achieve various degrees of success depending upon how wide their appeal is, the prolonged interest they can generate, how much variety there is in the play, how closely they approximate real-life systems, and to what degree one can acquire expertise through prolonged play. It is believed that the game according to the present invention is a game which will have a wide appeal since it can be played by participants of all ages, does generate prolonged interest, has a large amount of variety in the play, closely approximates real-life sport franchising and thereby appeals to people both with an interest in sports and an interest in "ownership" and capital, and has a good combination of luck and skill so that a modicum of expertise can be acquired through prolonged play.

The key principles and components of the game according to the present invention are the provision of a player board, distinct from the game board, for each participant, with the ability to build up a composition of player pieces on the player boards to participate in head-to-head competition with other participants, the provision of one chance means to advance pieces around the game board, and the provision of another chance means, which is utilized according to indicia on the game board, to provide for the selection of player pieces for the player boards. No other parlor games hae such a combination of principles, and it is believed that the combination of such principles provides a game that has all the desirable attributes mentioned above.

The game according to the present invention includes a game board with a plurality of consecutive playing sections arranged thereon (each of the playing sections having indicia associated therewith), a plurality of movable game pieces for movement from section to section of the game board, a plurality of player boards (one for each participant) and a plurality of player pieces for the player boards. At least two different indicia (e.g., different colors) are provided for distinguishing two distinct types of player pieces, and the indicia correspond to point values for those pieces. Chance means are provided for advancing the movable pieces around the game board from section to section, and separate chance player piece selection means are provided, having indicia thereon corresponding to the indicia for distinguishing between the at least two distinct types of player pieces. Selected playing sections on the game board have indicia indicating that the chance player piece selection means may be employed. Preferably, the player piece selection means are cards, the cards having two sets of indicia thereon, the color indicia corresponding to indicia distinguishing between the distinct types of player pieces, and indicia determining the placement of a player piece in a certain row on a player board. When sports franchising is the format of the game according to the invention, the player boards are divided into three distinct areas — "Field", "Bench" and "Injury", providing for simulation of actual conditions existing in a sports franchise situation. Also, each participant utilizes a given amount of money in building up his team, and in meeting various expenses of the team. Participants compete against each other in head-to-head competition during individual league games, the league games collectively comprising a season and the participant with the best won/-lost record at the end of the season being the winner. The playing sections on the game board are disposed in a continuous path having one section thereof indicating the start of play in a round, and one complete traversal of the continuous path of playing sections by a movable game piece constituting one round.

It is the primary object of the present invention to provide a parlor game that is enjoyable to play in general, and in particular simulates the building up of a professional sports team and the participation in a season with the sports team. This and other objects of the invention will become apparent from an inspection of the detailed description of the invention, and from the appended claims.

DETAILED DESCRIPTION OF THE INVENTION

Figure 1:
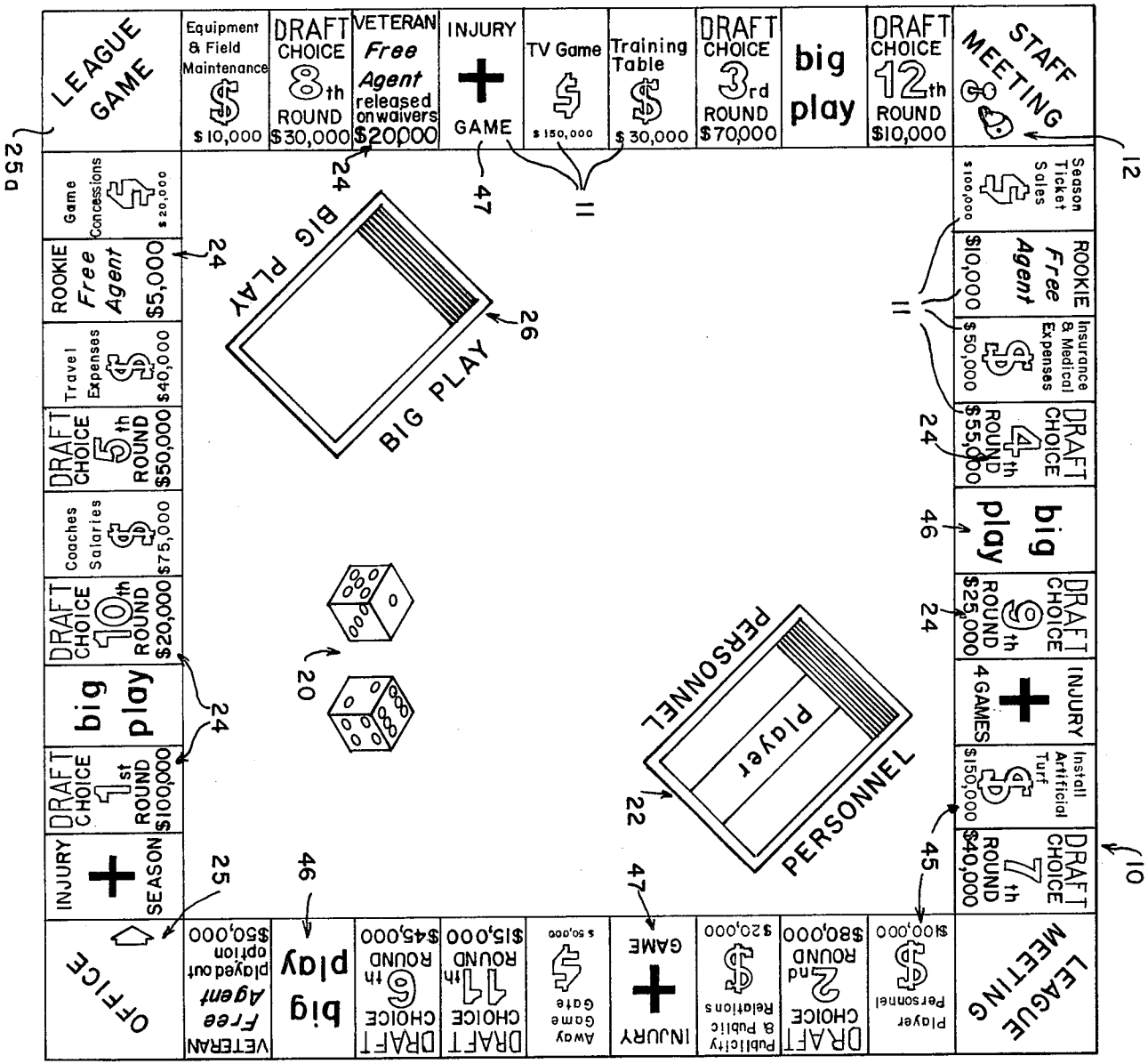
FIG. 1 is a top plan view of an exemplary game board according to the present invention, various accessory pieces being shown in perspective on the game board.

An exemplary game board according to the present invention is shown generally at 10 in FIG. 1, the game board 10 having a plurality of consecutive playing sections 11 arranged thereon, each of the playing sections having an indicia associated therewith. A plurality of movable game pieces 12 (one for each participant) are provided for movement from section-to-section of the game board. A plurality of player boards 14, one for each participant, are also provided, and a plurality of player pieces 15 for the player boards 14 are provided, at least two different indicia being provided for distinguishing two different distinct types of player pieces, such as player pieces 16, 17, 18 and 19. Chance means 20 are provided for advancing the movable pieces 12 around the game board 10 from section-to-section, and chance player piece selection means 22, having indicia 23 corresponding to the indicia for distinguishing between the at least two distinct types of player pieces, are provided. Selected playing sections 24 on the game board 10 have indicia indicating that the chance player piece selection means 22 are to be employed.

The game board 10 is preferably a conventional type of game board wherein the board may be folded in half for ease of storage. The playing sections 11 on the game board are preferably disposed in a continuous path around the periphery of the game board, as shown in FIG. 1, one playing section on the game board, the corner section 25, having "Office" indicia thereon, indicating the start of play for each round of the game as will be more fully described hereinafter. The game board has two sections formed thereon for receipt of chance player piece selection means 22, and for receipt of "Big Play" cards 26, which will be more fully described hereinafter. The exact indicia provided on the playing sections 11 will be dependent upon the particular format and rules of the game that is to be played and overlays may be provided for the playing sections 11 having different indicia thereon when it is desired to change the format or rules of the game, or different game boards may be provided.

The movable pieces 12 may comprise any form of movable piece, such as those illustrated in FIG. 1. When a football franchising game is to be played, the movable pieces 12 may take the form of football helmets; when a hockey franchising game is to be played they may take the form of hockey sticks, etc.

Figure 5:
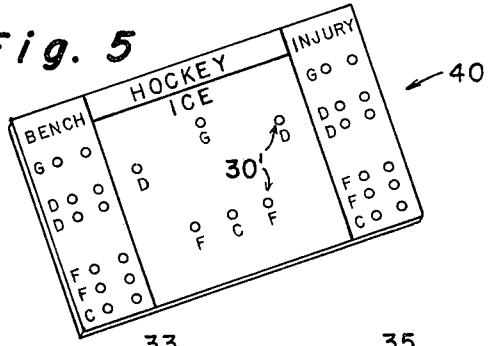
FIG. 5 is a perspective view of an exemplary overlay that may be utilized with the board of FIG. 2.
Figure 2:
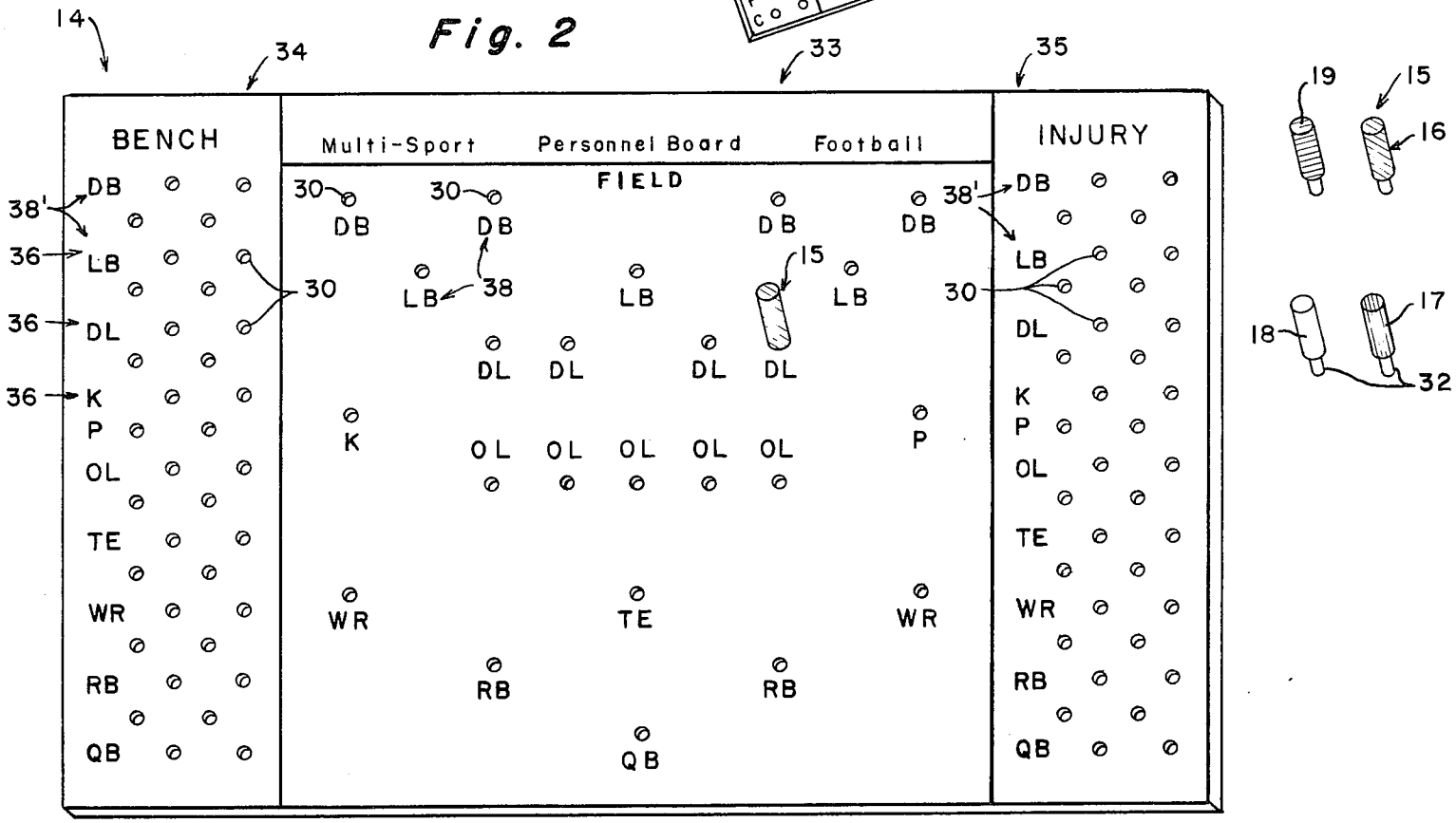
FIG. 2 is a top plan view of an exemplary player board according to the present invention, player pieces for the player board being shown in perspective.

The player boards 14 preferably are peg boards, having a plurality of openings 30 therein for receiving peg portions 32 of the player pieces 15 to hold the player pieces in a given position on the board 14. Preferably each board 14 is divided into three different sections, a Field section 33, a Bench section 34 and an Injury section 35. At least one opening 30 is disposed in each section 33, 34 and 35 for each of a plurality of rows 36 of openings 30. Each opening in a row of openings preferably also has indicia 38 form thereon, and similar indicia 38' is provided in the Bench and Injury sections corresponding to each row 36 of openings 30. Different indicia 38,38' are associated with each row 36. Each row of player piece retaining means 30 preferably indicates a different position of a player in an athletic contest. For instance, as shown in FIG. 2, a football format is provided for the board 14, some openings 30 are labelled "defensive back" (DB), others are labelled "offensive lineman" (OL), etc., so that both the offensive and defensive platoons, as well as the punter and kicker, are represented by indicia on board 14. The row 36 on the Field portion 33 of the board 14 is provided with the same number of openings 30 as there are players at the position indicated for the row 36 in an actual football game; for instance, five openings are provided for offensive linemen. In order to facilitate easy changeover of the format and/or rules of the game, one or more overlays 40 may be provided for the board 14 formed of sheets of material having different indicia printed thereon corresponding to the different format. For instance, in FIG. 5, an exemplary hockey format is provided instead of the football format shown in FIG. 2. The openings 30' provided in the overlay 40 preferably are aligned with some openings 30 in the board 14 so that the overlay 40 may be constructed as a thin paper or plastic sheet or the like with openings 30 on the board 14 actually still performing the function of retaining the peg portions 32 of the player pieces 15.

Figure 3:
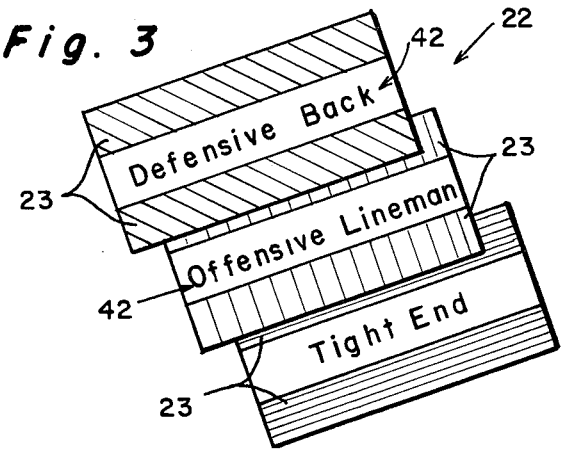
FIG. 3 is a top perspective of exemplary chance player piece selection means according to the present invention.

At least two different indicia are provided for distinguishing between two distinct types of player pieces 15, such as shown in FIG. 2, wherein four different indicia are provided, providing four different types of player pieces 15 – 16, 17, 18 and 19. Preferably, the indicia distinguishing between the player pieces 15 are colors. For instance, a plurality of player pieces 16 are of green color, a plurality of player pieces 17 are red, a plurality of player pieces 18 are white and a plurality of player pieces 19 are blue. The chance player piece selection means 22, such as shown in FIG. 3, have indicia 23 corresponding to the color indicia of the player pieces 15. For instance, some of the cards 22 have green indicia sections 23 thereon, some have blue indicia sections 23 thereon, some have red indicia sections 23 thereon, and some have white indicia sections 23 thereon. In addition, it is preferred that the player piece selection cards 22 also have an indicia section 42 thereof which corresponds to the indicia 38, 38' associated with the row 36 of player piece receiving means 30 on the player board 14. Thus, if one draws a card 22 having red indicia 23 and having the indicia offensive lineman 42, it means that one is to select a red player piece 17 from a group of player pieces and place that player piece 17 in either section 33, 34 or 35 of the board 14 in the row 36 which is labelled OL. The player pieces 15 have a different point value associated therewith depending upon the color thereof; for instance, the white player pieces 18 are worth one point, the green player pieces 16 are worth two points, the red player pieces 17 are worth three points and the blue player pieces 19 are worth four points. The point values of the player pieces 15 disposed in the Field section 33 of the playing board 14 may be added up to determine a participant's point value in each round of play.

Figure 4:
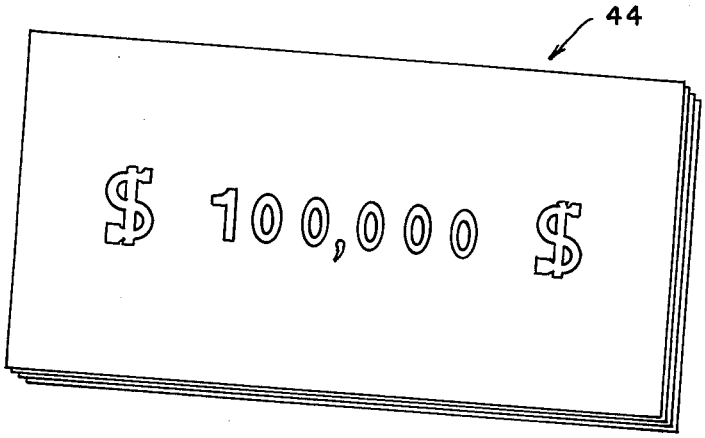
FIG. 4 is a top perspectiVe of exemplary play money for use in the game of the present invention.
Figure 6:
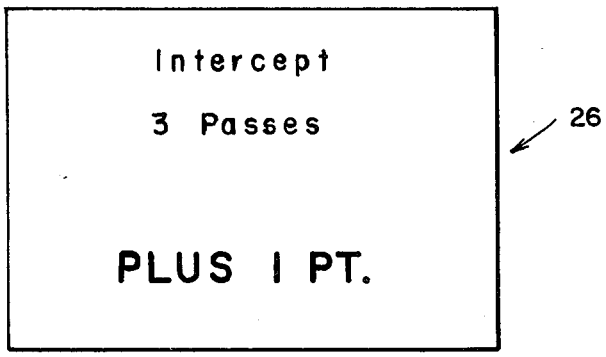
FIG. 6 is a top plan view of a Big Play card according to the present invention.

A deck of "Big Play" cards 26 (see FIGS. 1 and 6) may also be provided, each card 26 having printed on one face thereof a positive or negative point value, which is added to or subtracted from a participant's total point value of the player pieces 15 on the Field section 33 of his board 14. Also, it is preferred that money 44 (see FIG. 4) is provided for playing the game, the money being used to purchase player pieces 15 at different stages of the game, and various indicia are provided for playing sections 11 of board 10 which indicate the receipt or expenditure of money (see Sections 45 in FIG. 1). The playing sections 46 on the game board 10 indicate that a Big Play card is to be selected and the playing sections 47 on the game board 10 indicate that a player piece 15 is to be taken from the Field section 33 of the board 14 and placed in the Injury section 35 thereof in the same row 36 (the player piece 15 to be selected by cards 26).

Exemplary apparatus according to the present invention is set forth, and exemplary rules of the game and an exemplary method of play will now be set forth.

RULES OF THE GAME AND METHOD OF PLAY

It will be understood that the rules of the game and the method of play are subject to variation within a wide range, the principle factor being the build up of a group of player pieces 15 having maximum value on the playing section 33 of a player board 14. One set of rules embodying this principle for the play of a football franchising game is as follows:

Each participant becomes the owner/general manager (OGM) of a professional football team and tries to build up the best winning team through development of player personnel and manipulation of money. In general, the opposing OGMs move around the game board, in turn landing on spaces that enable them to improve the strength of their team through the acquisition of draft choices and free agents and landing on spaces that effect their finances positively or negatively. There are also spaces (Injuries and Big Plays) which constitute events over which the OGMs have no control and which effect the strengths of their teams, at least temporarily. During each trip around the game board 10, participants are matched against each other in league games in which the OGM whose team has the highest point value according to the player pieces 15 on his player board 14 is the winner. After a predetermined number of league games, the team with the best won/-lost record is the season champion and its OGM is the winner of the game.

The game board 10 is placed on a table, and the Big Play cards 26 are placed face down in their designated spot. Each participant takes a player board 14, and a movable game piece 12, which represents him as he goes around the board 10. One of the participants is designated as league treasurer and gives to each OGM an operating budget of $1,000,000 which is in the form of playing money 44. Beginning with all movable pieces 12 in the "Office" space 25, the OGM whose team point value is lowest after the initial player piece distribution throws the die 20 and moves his or her piece 12 in the direction of the arrow to the appropriate playing section 11. The OGM proceeds to comply with the instructions of the section 11 landed on. The OGMs proceed in turn, moving around the game board 10 until any OGM's piece 12 lands on or passes the Office 25. After the passing OGM complies with the direction of the space 11 landed on, all pieces 12 are immediately returned to the Office 25 and a league game is concluded. In other words, there are no further throws of the die 20 once an OGM goes around the board and lands on or passes Office 25. (Alternatively, a game is concluded when the "League Game" square **25*a* is reached or passed by the first OGM after "Office" is passed, the game thus consisting of 1¼ passes around the Board 10**).

According to a predetermined schedule, OGMs are matched against each other in league games after completion of a previous league game. All league games taking place at any one time are concluded as soon as any one OGM completes a league game. The league games consist of the opposing OGMs calculating and comparing their team point values (values of player pieces 15 on boards 14). The OGM with the highest point value wins the league game. The OGM whose team has the best record at the end of the season is the winner of the entire game. One OGM is designated statistician and keeps won/lost records of each team through the season. After a league game is played, when the OGMs return to the Office space 25, the OGMs will take their turns throwing the die 20 in order of worst won/lost records (the worst won/lost record goes first, the second worst won/lost record goes second, etc.).

There are four colors of player pieces 15 (green 16, red 17, white 18 and blue 19), with corresponding color indicia 23 being provided on the player piece selection cards 22. The blue pieces 19 are four points, red pieces 17 three, green pieces 16 two and white pieces 18 one. There are 96 total cards 22, 24 of each color broken down into positions as follows: 16 defensive backs, 12 linebackers, 16 defensive linemen, four kickers, four punters, 20 offensive linemen, four tight ends, eight wide receivers, eight running backs and four quarterbacks. During the game, when cards 22 are drawn from the deck, both indicia 23 and 42 (i.e., green defensive back) have significance; however, during initial player distribution only the color system (23) has significance.

Initial player piece distribution consists of 40 players being distributed to each OGM using the player selection cards 22 and the color indicia system 23 thereon. First, six cards are dealt out to each OGM, these cards comprising an OGM's defensive back despite any indicia 42 printed on the cards 22. Each owner then takes six player pieces 15 corresponding to the colors of his six cards and places them on his player board 14, the four "best" (according to point value) being placed on the Field section 33 of the board 14 and the remaining two being placed on the Bench section 34 of the board 14, all in the row 36 having the DB indicia 38. Similarly, five cards are dealt to each owner which are linebackers and corresponding player pieces 15 are placed on the personnel board 14, three in the Field and two on the Bench. Similarly, six defensive linemen cards are dealt out, one kicker, one punter, seven offensive linemen, three tight ends, four wide receivers, four running backs and three quarterback cards. EAch OGM then has 40 total players, 24 on the Field section 33 and 16 on the Bench section 34. (During the play of the game, it is permissible to have less then 40 players at any one time.) Player distribution is now completed, the player piece selection cards 22 are shuffled and placed face down on the designated area of the game board 10 and the game can begin.

Team point value is calculated by adding up the total points represented by the 24 player pieces 15 on the Field section 33. The point value of the player pieces on the "Field" plus any bonus points and Big Play points determine the total team point value. As mentioned above, the team point value is used during the play of the game to determine the winner of each league game during the season and to establish the order of play.

The game board 10 consists of 40 sections 11 divided into the following categories:

Personnel (12 draft choices and four free agents)
Finances (eight cost and four revenue producing items)
Injury (4)
Big Play (4)
Non-Action Corners (4).

When an OGM lands on a draft space 24 (which indicates that the player piece selection cards 22 may be employed), he or she has the option of acquiring that draft choice or doing nothing. To acquire the draft choice, the OGM must pay the amount of money printed on the space 24 on the game board 10 (the money is put into the league treasury) and then the OGM selects a card or cards 22 from the player personnel deck. Because the higher round draft choice costs more, and statistically should result in the acquisition of a player piece 15 of higher value, the method of drawing cards from the personnel deck is systemized accordingly. The following chart summarizes the draft choice spaces:

| Round | Cost | Card Selection |
|---|---|---|
| 1 | $100,000 | Best of 3 |
| 2 | 80,000 | Best of 2 |
| 3 | 70,000 | Best of 2 |
| 4 | 55,000 | 1 card |
| 5 | 50,000 | 1 card |

-continued

| Round | Cost | Card Selection |
|---|---|---|
| 6 | 45,000 | 1 card |
| 7 | 40,000 | 1 card |
| 8 | 30,000 | Worst of 2 |
| 9 | 25,000 | Worst of 2 |
| 10 | 20,000 | Worst of 2 |
| 11 | 15,000 | Worst of 3 |
| 12 | 10,000 | Worst of 3 |

When a draft choice is acquired, a player piece 15 of proper color (according to the indicia 23 on the player card or cards 22 selected) is taken and placed on the Bench or Field sections of the board 14 in an opening 30 having indicia 38 thereof corresponding to the indicia 42 on the card 22. If the acquisition of the draft choice puts the OGM's roster level over 40, he or she must release a player on Waivers. This means that another OGM may purchase the released player for the standard waiver price of $1,000, the owner with the worst won/lost record having the first option at claiming the waivered player, etc.

When one lands on a free agent space, the same basic procedural method is followed as when one lands on a draft choice space. The following chart summarizes the utilization of the player piece selection means 22 for each of the designated free agent spaces:

| Status | Cost | Card Selection |
|---|---|---|
| Rookie | $ 5,000 | Worst of 3 |
| Rookie | 10,000 | Worst of 3 |
| Veteran | 20,000 | Worst of 2 |
| Veteran | 50,000 | 1 card |

If any OGM uses up his $1,000,000 operating budget during the season, the only way to raise money is to sell player pieces to other OGMs, or to land on Income Producing Squares 46. If an OGM lands on a cost space 45 and lacks the necessary funds to meet the indicated financial obligation, the OGM may sell player pieces to other OGMs at that time. Of course, when an OGM lands on an income producing space 46, he or she receives from the league treasury the amount of money indicated on the space.

There are four injury spaces 47 on the game board 10, two single game injuries, one four game injury and one season injury. When an OGM lands on an injury space 47, he or she proceeds to take a card 22 from the top of the personnel deck. If the OGM has a player piece on the Field section 33 of his board 14 that corresponds to that card 22 (both indicia 23 and 42), that player piece is removed from the Field 33 and the player piece 15 is placed in the Injury section 35 of the board 14 in the same row 36, with the corresponding same indicia 38'. If the top card 22 does not correspond in both color (23) and position (42) to a player piece 15 on the OGM's Field section 33, the next card is taken and so on until a match is made. A game injury space means that the injured player must remain out of competition for the next league game. A four game injury keeps the player in the injured column through four league games, and the season injury means that the player is permanently removed from the game. While an injury usually creates a roster deficit (less than 40 players), no immediate step may be taken to replace the injured player, but rather the player may only be replaced through natural acquisition (draft or free agent spaces or a transaction).

Big Play cards 26 are selected when an OGM's movable piece 12 lands on a Big Play section 46. The OGM drawing a Big Play card 26 should keep the negative or positive value thereof to himself and not reveal that information to other OGMs until the termination of the league game in which it is drawn. The value on the card 26 (see FIG. 6) is added to or subtracted from the team point value in the next league game played (only). After that league game, all Big Play cards 26 are returned to the deck and the deck is reshuffled before the ensuing round commences. Preferably, there six Big Play cards with a value of plus two points, 10 with a value of plus one point, eight with a value of minus one point and four with a value of minus two points.

Along with the Big Play points, team point value also is effected by a bonus point system that rewards strength in a given position. For instance an OGM may add one point to his team point value for each of the following situations: all four defensive backs on the Field are blue; all three linebackers are blue; all four defensive linemen are blue; both the kicker and punter are blue; all five offensive linemen are blue; both running backs are blue; the quarterback is blue; and the three receivers (the two wide receivers and the one tight end on the Field) are blue.

OGMs may buy, sell or trade amongst each other during portions of the play of the game and after the initial player selection, but before the first league game actually begins. During trips around the game board during each league game, owners may negotiate transactions only until the first player piece 12 lands on or passes the "League Meeting" section of the board 10. Also, no transactions may take place at all during the last two league games of the season. The only exception to this rule is when an OGM has spent all of his or her operating budget and cannot meet the financial obligation of a money space 45 landed on.

The OGM with the best won/lost record and the end of the season, is the winner.

When a more complete version of the game is desired, a "pre-season" phase of the game may be played. When it is desired to include the pre-season phase, each OGM receives 48 players initially — instead of 40 — according to the following distribution: seven defensive backs, six linebackers, seven defensive linemen, two kickers, two punters, eight offensive linemen, three tight ends, five wide receivers, five running backs and three quarterbacks. During the next several minutes the OGMs must reduce their rosters to 40 players according to preset time limits covering an evaluation period, a transaction period, and a waiver period. In the evaluation period, each OGM studies his own and his opponent's personnel, calculating the initial team point values and strengths and weaknesses. During the transaction period, OGMs may buy, sell or trade amongst each other. In the waiver period, each OGM must cut players so that a 40 player roster is reached. This means that each OGM offers a written list (or sets player pieces 15 upside down in their holes 30) indicating which players are being released on waivers. Other OGMs may claim an opponent's released player for the standard waiver price of $1,000. In the event that more than one OGM claims the same player, the OGM with the lowest team point value gets the released player. (A coin flip or throw of the die 20 may be used to break a tie.) An OGM who claims a waived player must, of course, then cut another player so that his roster total remains at no more than 40. Released players who are unclaimed at the end of the waiver period are no longer a part of the game, and their representative player pieces 15 are removed from the personnel boards 14. The participants may determine the extent of the time period for each phase of the pre-season, but normally 5 minutes would be allotted for the evaluation period, 15 minutes for the transaction period and 5 minutes for the waiver period. When the waiver period has ended, and 40 man rosters are set, player distribution is complete and the season can begin as discussed above.

Alternatively, the initial player distribution can be the same for each participant. For instance, each participant will receive 10 blue player pieces 19, 10 red player pieces 17, 10 green pieces 16 and 10 white player pieces 18. The participant must then utilize six of the player pieces as defensive backs, five as linebackers, six as defensive linemen, one as a kicker, one as a punter, seven as offensive linemen, three as tight ends, four as wide receivers, four as running backs and three as quarterbacks. The only restriction on initial placement is that a blue player piece 19 may not be placed at the quarterback position, nor may any of the bonus point situations described above exist initially.

It will thus be seen that according to the present invention a game has been provided which includes the building up of player pieces on a participant's own player board with an attempt to maximize the point value associated with a participant's player board. While the invention has been herein shown and described in what is presently conceived to be the most practical and preferred embodiment of the invention, it will be apparent to those of ordinary skill in the art that many modifications thereof may be made within the scope of the invention, which scope is to be accorded the broadest interpretation of the appended claims so as to encompass all equivalent structures and devices.

What is claimed is:

1. A parlor game for a number of participants, comprising a. a game board with a plurality of consecutive playing sections arranged thereon, each of said playing sections having indicia associated therewith, b. a plurality of movable game pieces for movement from section to section of the game board, one for each participant, c. a plurality of player boards, one for each participant, d. a plurality of player pieces for the player boards, at least two different indicia being provided for distinguishing two distinct types of player pieces, e. chance means for advancing the movable pieces around the game board from section to section, f. chance player piece selection means having indicia corresponding to the indicia for distinguishing between the at least two distinct types of player pieces, and g. selected playing sections on the game board having indicia indicating that the chance player piece selection means may be employed.

2. A game as recited in claim 1, wherein said player boards are peg boards, and wherein said player pieces are pieces having peg portions for insertion in openings in said peg boards.

3. A game as recited in claim 2, wherein each of said player peg boards is divided into three distinct areas, there being provision for at least one playing piece in each area in each of a plurality of rows of player piece receiving openings in said player boards, each row and each area having distinctive indicia associated therewith, and further comprising at least one overlay for said peg board for changing the number of openings in each row and/or in each area on said peg board and for changing the indicia associated with each row.

4. A game as recited in claim 1, further comprising a supply of playing money, indicia on selected sections of said game board indicating the expenditure or receipt of money.

5. A game as recited in claim 1, wherein said playing sections on said game board are disposed in a continuous path having one section thereof indicating the start of play in a round, at least one complete traversal of the continuous path of playing sections by a movable game piece being necessary to constitute one round.

6. A game as recited in claim 1, wherein said player boards are divided into three distinct areas, provision for at least one player piece in each area in each of a plurality of rows of player piece retaining means on said player boards being provided, said three distinct areas having Field, Bench and Injury provided as indicia thereon, and different other indicia being associated with each row.

7. A game as recited in claim 6, wherein the indicia associated with each row of player piece retaining means indicates a different position of a player in an athletic contest, and wherein said at least two different indicia for distinguishing between said player pieces indicate relative value of said player pieces and wherein said player piece selection means have indicia thereon corresponding to the player board row indicia thereby indicating in which row and player position on a player board the selected player piece is to be placed.

8. A game as recited in claim 7, wherein said playing sections on said game board are disposed in a continuous path having one section thereof indicating the start of play in a round, at least one complete traversal of the continuous path of playing sections by a movable game piece being necessary to constitute one round, and wherein a point value is assigned to each player piece dependent upon the indicia thereon, and wherein the indicia for each player piece on the Field section of each player board is added at the end of each round to determine which of two participants is the winner of that round.

9. A game as recited in claim 8, further comprising a deck of Big Play cards, each card having a plus or minus point value associated therewith to be added to a participant's point total at the end of each round.

10. A game as recited in claim 1, wherein said chance player piece selection means includes a deck of player selection cards, and wherein the different indicia distinguishing between the player pieces and provided on the cards are colors.

* * * * *